US006480167B2

(12) United States Patent
Matthews

(10) Patent No.: US 6,480,167 B2
(45) Date of Patent: Nov. 12, 2002

(54) FLAT PANEL ARRAY ANTENNA

(75) Inventor: Peter G. Matthews, Gorham, ME (US)

(73) Assignee: Gabriel Electronics Incorporated, Scarborough, ME (US)

( * ) Notice: Subject to any disclaimer, the term of this patent is extended or adjusted under 35 U.S.C. 154(b) by 0 days.

(21) Appl. No.: 09/802,228

(22) Filed: Mar. 8, 2001

(65) Prior Publication Data

US 2002/0126062 A1 Sep. 12, 2002

(51) Int. Cl.[7] ..... H01Q 9/28
(52) U.S. Cl. ..... 343/795; 343/853; 343/810
(58) Field of Search ..... 343/700 MS, 795, 343/853, 810, 872, 770, 910, 911 L, 911 R

(56) References Cited

U.S. PATENT DOCUMENTS

| | | | | |
|---|---|---|---|---|
| 4,097,868 A | * | 6/1978 | Borowick | 343/727 |
| 4,114,163 A | * | 9/1978 | Borowick | 343/815 |
| 5,285,212 A | * | 2/1994 | McNiece | 343/795 |
| 5,936,590 A | * | 8/1999 | Funder | 343/795 |
| 6,069,590 A | * | 5/2000 | Thompson, Jr. et al. | 343/795 |

OTHER PUBLICATIONS

Hyneman et al., "A Technique for the Synthesis of Shaped –Beam Radiation Patterns with Approximately Equal–Percentage Ripple," *IEEE Transactions on Antennas and Propagation*, vol. AP–15, No. 6, Nov. 1967, pp. 736–743.

Langeley, et al., "Multi–Octave Phased Array for Circuit Integration Using Balanced Antipodal Vivaldi Antenna Elements," *IEEE*, 1995, pp. 178–181.

Moody, "The Systematic Design of the Butler Matrix," *IEEE Transactions on Antennas and Propagation*, Nov. 1964, vol. AP–12, pp. 786–788.

Rotman et al., "Wide–Angle Microwave Lens for Line Source Applications," *IEEE Transactions on Antennas and Propagation*, Nov. 1963, pp. 623–632.

Roy, "Application of Smart Antenna Technology in Wireless Communications Systems," ArrayComm, Inc., San Jose, CA, date unknown.

Yngvesson et al., "Endfire Tapered Slot Antennas on Dielectric Substrates," *IEEE Transactions on Antennas and Propagation*, vol. AP–33, No. 12, Dec. 1985, pp. 1392–1400.

* cited by examiner

*Primary Examiner*—Tan Ho
(74) *Attorney, Agent, or Firm*—Bromberg & Sunstein LLP

(57) ABSTRACT

A flat panel antenna array for generating multiple beams across a wide frequency band. Radiating elements and feeds are supported on radiator boards disposed in parallel planes, all perpendicular to a network board that supports a time delay structure, such as a Rotman lens, to phase the signal fed to respective radiating elements in order to form beams pointing in specified directions. Ground sheets, parallel to the network board and back structure of the antenna, interlock with a narrowed region of the radiator boards and with cross braces, providing mechanical support and overlap to reducing cross-polarized radiation otherwise coupled by slots in the ground sheets.

14 Claims, 4 Drawing Sheets

FLAT PANEL ARRAY ANTENNA

FIELD OF THE INVENTION

The present invention relates generally to flat panel antenna arrays for generating multiple, simultaneous, beams for the transmission and reception of directional microwave communications.

BACKGROUND ART

The rapid expansion of the delivery of wireless services for telephony, messaging and internet access is generating the need for more advanced and cost effective antenna solutions than are currently available. One such solution is the multiple beam base station antenna used in point to multi-point delivery systems. This single antenna acts like a number of antennas superimposed on top of one another to deliver full aperture gain beams to adjacent azimuth sectors. Multiple beam antennas increase the channel capacity of a system without the need to install additional antennas by allowing multiple transceivers to be connected to a single base station antenna and thereby communicate with multiple subscribers, each subscriber within a sector covered by one of the beams generated by the antenna. In addition to being able to increase system capacity, these multi-beam antennas can also be integral parts of "smart antenna" systems that can also increase the performance of wireless delivery systems in various ways such as the following: Smart antenna systems may 'follow' mobile subscribers electronically; multiple sectors may be covered with a single transceiver; signal integrity may be enhanced through beam diversity; and any given beam may be dynamically shaped to enhance interference rejection. Advantages of smart antenna systems are addressed by Richard H. Roy, "Application of Smart Antenna Technology in Wireless Communication Systems", White Paper produced at ArrayComm, Inc., 3141 Zanker Road, San Jose, Calif. 95134, which paper is incorporated herein by reference.

SUMMARY OF THE INVENTION

In accordance with preferred embodiments of the invention, there is provided an antenna array. The antenna array has a multi-beam forming network disposed on a circuit board in plane referred to as a network board plane. The antenna array also has a plurality of radiator boards, each radiator board disposed in one of at least one radiator board plane in such a way that each radiator board plane is perpendicular to the network board plane. Several radiator elements are disposed on each radiator board and coupled to the multi beam forming network so that the plurality of radiator elements create at least one beam directed in a specified direction.

While antenna beams are described herein in terms of transmission and radiation of electromagnetic energy, it is to be understood that such description applies in equal measure to the reception of such radiation.

In accordance with further embodiments of the invention, the multi-beam forming network may be a time delay structure, or, more particularly, a Rotman lens. Beam ports of the Rotman lens may be coupled pairwise to individual input connectors. The antenna may also have an array port circuit for coupling energy to the radiator boards, and at least one attenuator in the array port circuit.

In accordance with yet further embodiments of the invention, each radiator board may also include an elevation feed network, and each radiator element may be a dipole element. The antenna array may also have a first ground sheet with a plurality of slots, a radiator board extending through each slot of the first ground sheet. The antenna array may also have a second ground sheet with slots, a radiator board extending through each slot of the second ground sheet. The ground sheets may interlock with notches in the radiator boards so as to create a plurality of effective slots narrower than the characteristic width of the radiator boards. Additionally, a plurality of cross braces may be provided, one cross brace disposed across each row of radiator boards.

A radome having no mechanical contact with either the network board or the radiator boards may be provided, in accordance with a further embodiment of the invention, for shielding the multi-beam forming network and radiator boards from environmental effects.

BRIEF DESCRIPTION OF THE DRAWINGS

The present invention will be more readily understood by reference to the following detailed description taken with the accompanying drawings, in which.

DETAILED DESCRIPTION OF SPECIFIC EMBODIMENTS

A broadband, efficient and compact multiple-beam phased array antenna, in accordance with an embodiment of the present invention, is now described with reference to FIGS. 1 and 2. These figures refer specifically to a six-beam panel antenna for operation in the 2.4–2.49 GHz band, however the concepts described herein and claimed in the appended claims may be advantageously applied to other bands and to other, and, particularly, wider, frequency ranges. Additionally, antennas for the generation, by a single antenna structure, of any number of beams are within the scope of the present invention.

Figure 1:
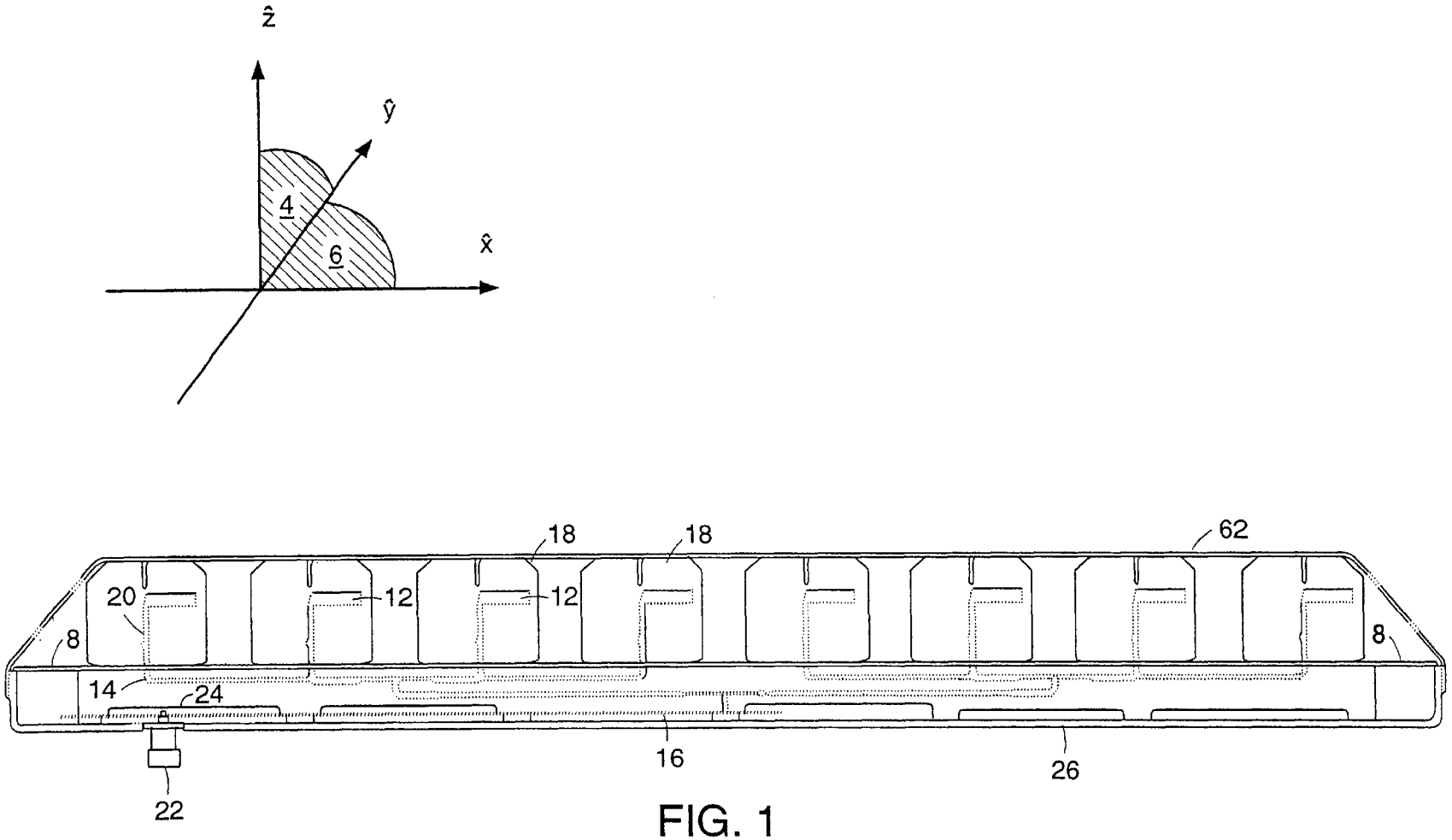
FIG. 1 shows a side view in cross section of an antenna array in accordance with a preferred embodiment of the present invention.

FIG. 1 shows a side view in cross section of an antenna array designated generally by numeral 10. In accordance with preferred embodiments of the present invention, multiple antenna elements 12 are fed by microwave networks designated by dashed lines 14. Microwave networks 14 for excitation of elements 12 so as to generate multiple, simultaneous beams are disposed upon two sets of microwave circuit boards that are perpendicular to one another with microwave transitions between them.

A first network 16 may be referred to herein, without limitation, as the "lens" because it may include a Rotman style lens as described in W. Rotman and R. F. Turner, "Wide Angle Lens for Line Source Applications", *IEEE Trans. on Antennas and Propagation*, vol. AP-11, November 1963, pp. 623–632, which is appended hereto and incorporated herein by reference. Rotman lens 16 generates the multiple array excitations so as to provide multiple distinct antenna beams in the azimuth plane 6.

A second set of circuit boards 18, designated as "radiator boards," supports both a microwave network 20 for the elevation plane 4 as well as radiating elements 12, both fabricated in microstrip. The networks 20, otherwise referred to as "feeds," on the radiator boards 18 are typically identical and generate the array excitation for a single beam in the elevation plane.

Figure 2:
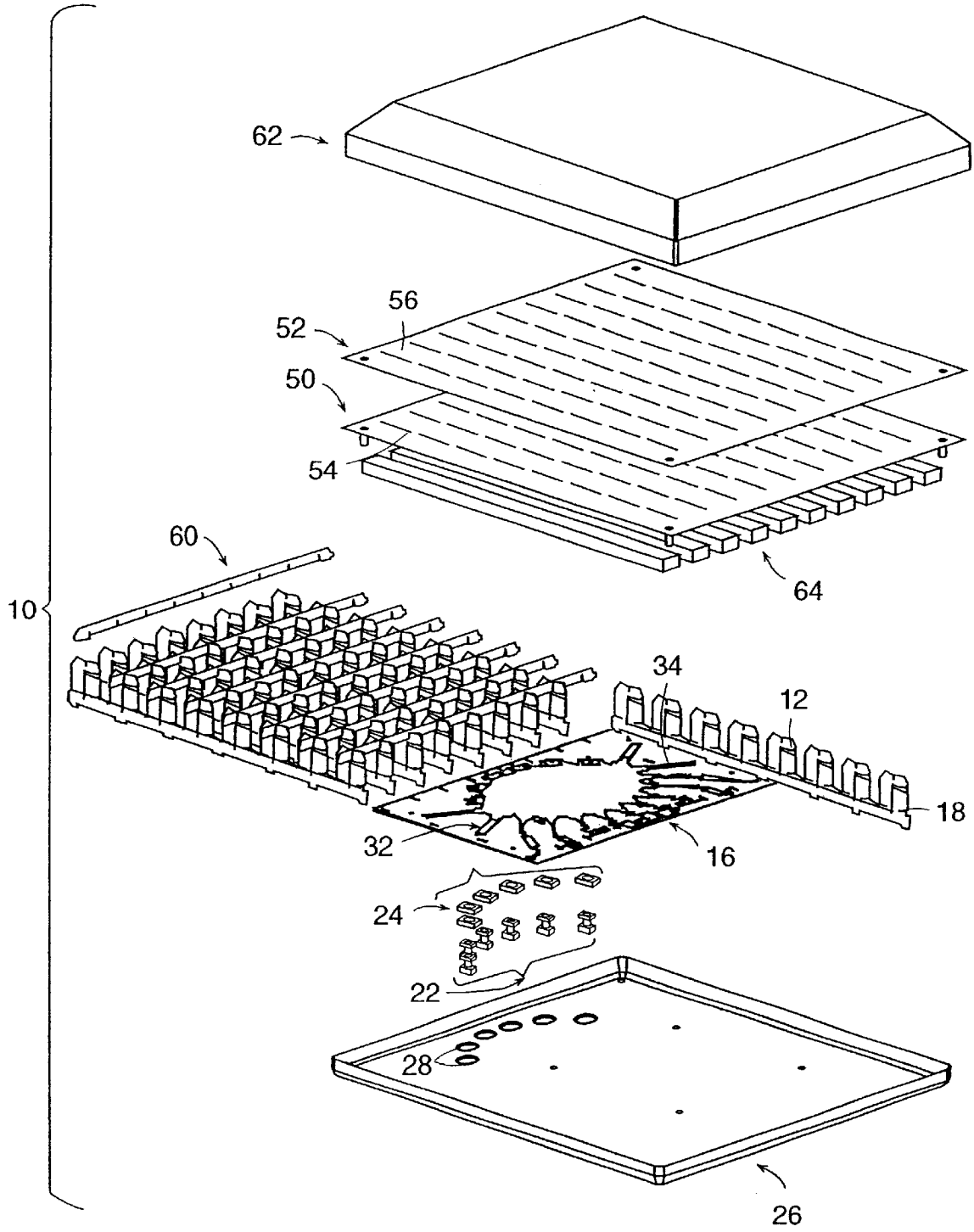
FIG. 2 shows an exploded perspective view of the antenna array of FIG. 1.

Referring now to the exploded view of FIG. 2, six beam port connectors 22, each connector corresponding to a different antenna beam, are directly connected, for purposes of RF coupling, to the network circuit board 16 via electrically conductive connector plates 24 (best seen in FIG. 1). Connector plates 24 provide a space between network board 16 and antenna back structure 26 when antenna 10 is assembled. Connectors 22 protrude through clearance holes 28 in back structure 26. This arrangement advantageously allows the circuit board assembly comprised of network board 16 and radiator boards 18 to move with respect to back structure 26 when required due to differences in the coefficients of thermal expansion between the circuit board materials and the material of the back structure. Additionally, mechanical and electrical connections between the network and radiator boards are advantageously accommodated, as described below.

In accordance with preferred embodiments of the invention, mechanical joints between network board 16 and radiator boards 18 are not directly subjected to the wind-load and thermal expansion forces of the entire antenna structure. The details of the electrical/mechanical right angle transition from the network board to the radiator board will be discussed below with reference to FIG. 3.

The Network Board

Figure 5:
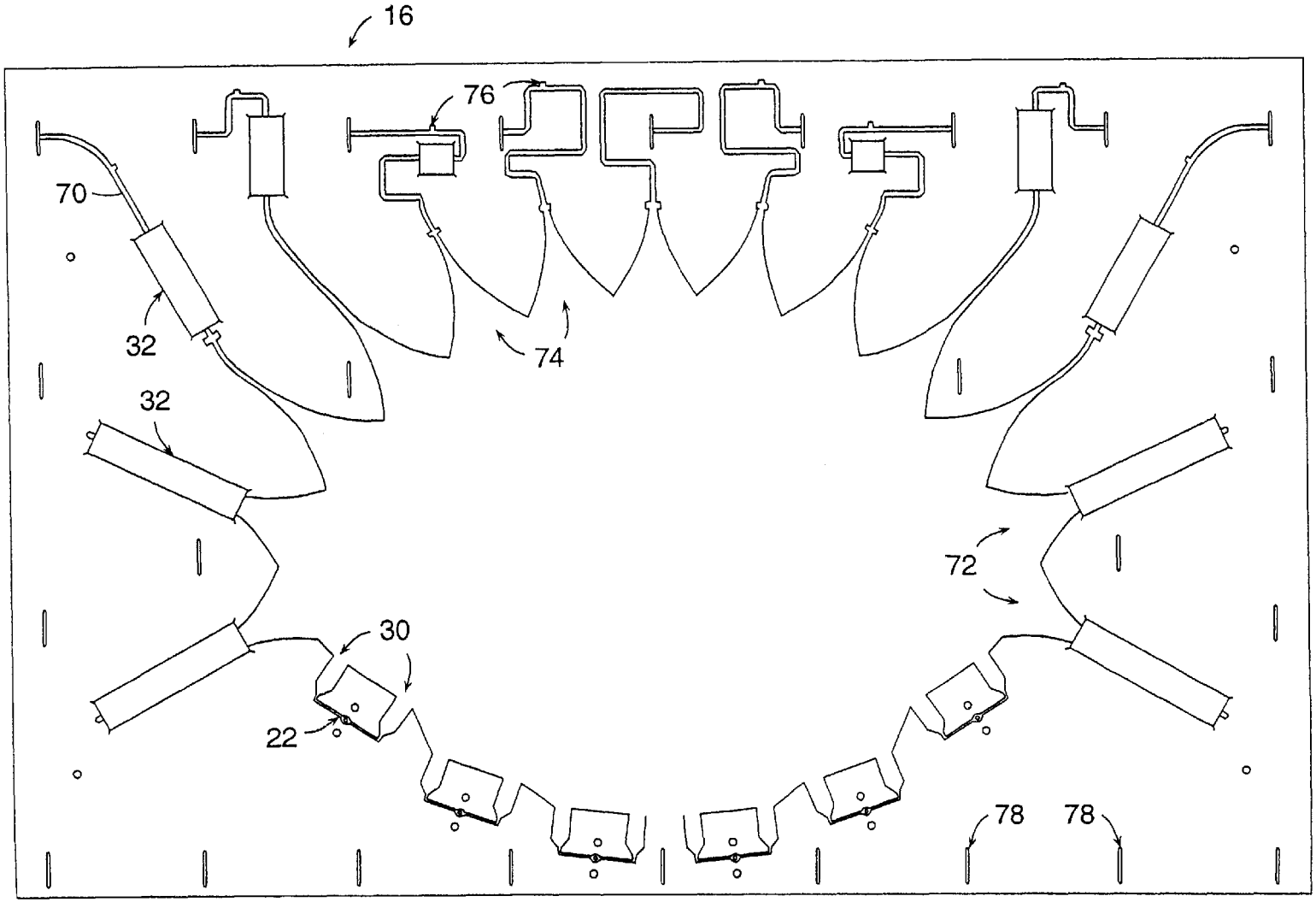
FIG. 5 is a top view of a network board showing beam ports, array ports and attenuators, in accordance with embodiments of the present invention.

Referring to FIG. 5, the microwave circuitry on network board 16 is based on the work of Rotman. The Rotman style lens is a time delay structure, implemented in microstrip transmission lines 70, that is used to feed a linear array of elements with signals properly phased, as known in the art, to form beams pointing in different directions. More particularly, a Rotman lens may be used to feed an array of linear arrays each with identical elevation feed networks (also implemented in microstrip transmission lines) placed perpendicular to the plane of the lens, thus forming a 3-dimensional microwave network. This 3D network has the advantage in that the elevation beam shape can be designed independently of the azimuth beams. This network may be used to provide a beam having a "cosecant squared" power distribution in the azimuthal plane 6, as described by R. F. Hyneman and R. M. Johnson, "A Technique for the Synthesis of Shaped-Beam Radiation patterns with Approx. Equal-Percentage Ripple", Vol. AP-15, November 1967, pp. 736–742, which is herein incorporated by reference, thereby further optimizing coverage within each sector cell.

Because the Rotman lens is structure based upon an actual time delay, rather than a reactive, structure, the beam-pointing angle is substantially frequency independent, and typically does not limit the ultimate bandwidth of the entire antenna structure.

Other multi-beam forming networks, albeit less flexible than the Rotman lens, are within the scope of the present invention, as described herein and as claimed in any appended claims. One example of a multi-beam forming network is a Butler matrix, as described by H. J. Moody, "The Systematic Design of the Bulter Matrix", *IEEE Trans. on Antennas and Propagation*, Vol. AP-12, November 1964, pp. 786–788, which is incorporated herein by reference.

In accordance with alternate embodiments of the invention, the number of beam ports (i.e. where the connector is input to the lens) may be unequal to the number of array ports (where the radiator boards are connected), thus, the array size and spacing can be determined independent of the beam forming network. This may enable particularly efficient use to be made of the aperture to generate the desired beams and coverage.

The Rotman lens configuration may advantageously allow the field amplitude to be tapered across the array to produce low sidelobes. Referring again to FIG. 5, each connector input 22 feeds two beam ports 30 via microstrip traces. These beam ports 30 form a two-element array within the lens that concentrates the radiated energy toward the center of the array ports 74. In addition to using this technique to taper the amplitude of radiated power at the outer edges of the array, attenuators 32 may be added to the array port circuitry to further suppress the energy radiated towards the edges of the array. Attenuators 32 may also be used to absorb stray energy entering dummy array ports 72. Attenuators 32 used in accordance with the invention are preferably metalized mylar film of specified resistivity, in ohms per square, that is applied directly on top of the original microstrip trace 34 using a film adhesive. The amount of attenuation is determined by the length of the mylar film along the direction of propagation of the microstrip.

The Radiator Boards

Radiator boards 18 house both the elevation-beam network 20 of feeds and the radiating elements 12 as shown in FIGS. 1 and 2. The radiators 12 shown in FIG. 1 are printed dipoles positioned ¼ wavelength above a conducting ground sheet 8. The choice of radiating element is subject to bandwidth requirements of the antenna array. While radiating elements 12 are shown as printed dipoles, other radiating element structures are within the scope of the present invention, some of which provide substantially wide bandwidths.

Radiating elements 12, for example, may be multiple band dipole elements, or Linear Tapered Slots, or Vivaldi elements. The following two papers, describing broadband antenna elements, are incorporated herein by reference: K. Sigrid Yngvesson, et. el., "Endfire Tapered Slot Antennas on Dielectric Substrates," Vol. AP-33, December 1985, pp. 139–1400, and D. S. Langley, "Multi-Octave Phased Array for Circuit Integration using Balanced Antipodal Vivaldi Antenna Elements," *IEEE Antennas and Propagation conference Difgest,* 1995, pp. 178–181. Various radiating element designs may be advantageously employed for specified applications.

An important feature of the dipole element is that it naturally produces a null in the radiation pattern in the plane of the array in both the azimuth 6 and elevation 4 planes. This null dramatically inhibits radiative coupling between adjacent antennas, as they would be mounted side by side on a tower or building rooftop. Mechanically, radiator boards are attached to network board 16 at slots 78 shown in FIG. 5.

Coupling of the Network Board to Radiator Board

Figure 3:
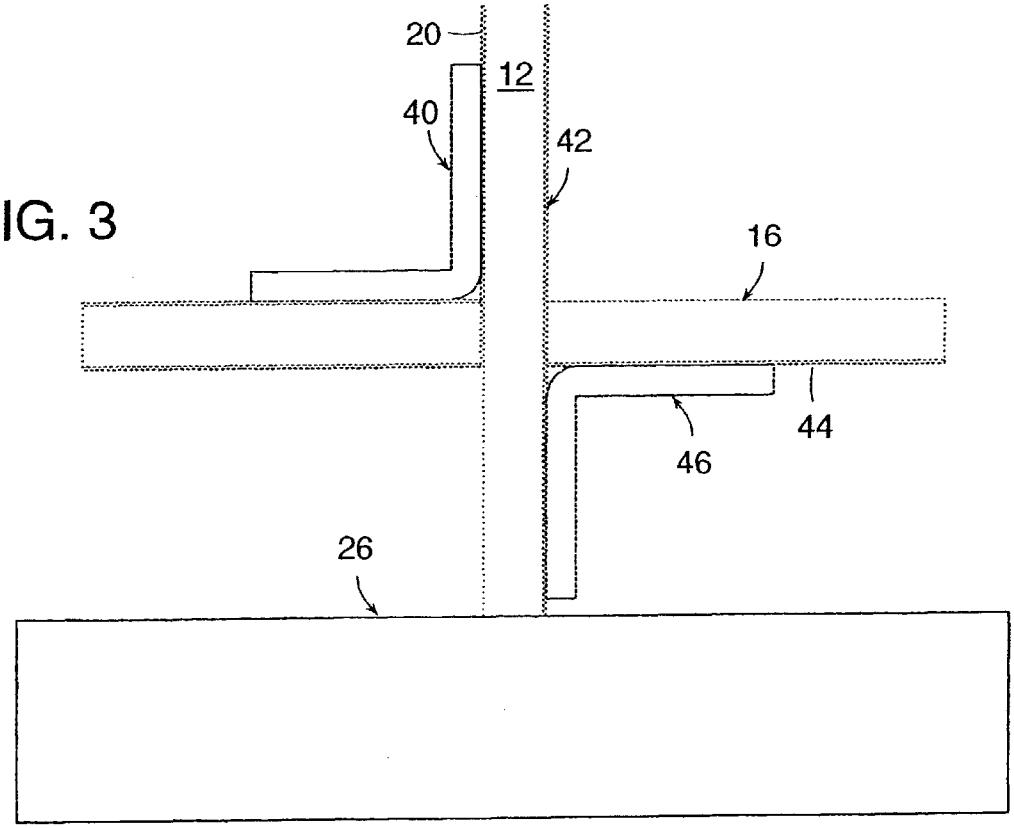
FIG. 3 is a cross-sectional view of the coupling between the network board and one of the radiator boards showing the mechanical and electrical coupling between them.

Referring to FIG. 3, the multi-beam forming networks 34 of the network board 16 are coupled to elevation beam network elements 20 of the radiator boards 12, in accordance with preferred embodiments of the present invention, by means of a right angle microstrip bend. Additionally, metal angles 40, typically brass, comparable in width to the microstrip trace, are soldered to provide electrical conductivity and structural support. A second metal angle 46, is soldered to the ground plane cladding (typically copper) 42, 44, of the radiator and network boards, respectively, to provide ground continuity and mechanical support. Second metal angle 46, typically brass, is preferably approximately six times the width of the microstrip trace. A single tuning stub 76 (shown in FIG. 5) for each vertical feed has been found sufficient to match the reactance of the bend and soldered metal tabs to better than 30 dB return loss over a 2.5% band, and better than 20 dB over a 10% frequency bandwidth. It will be clear to persons skilled in the microwave art that other tuning stub schemes may be employed. Alternatively, printed circuit board coaxial connectors may be used within the scope of the invention.

The Ground Sheets

Figure 4:
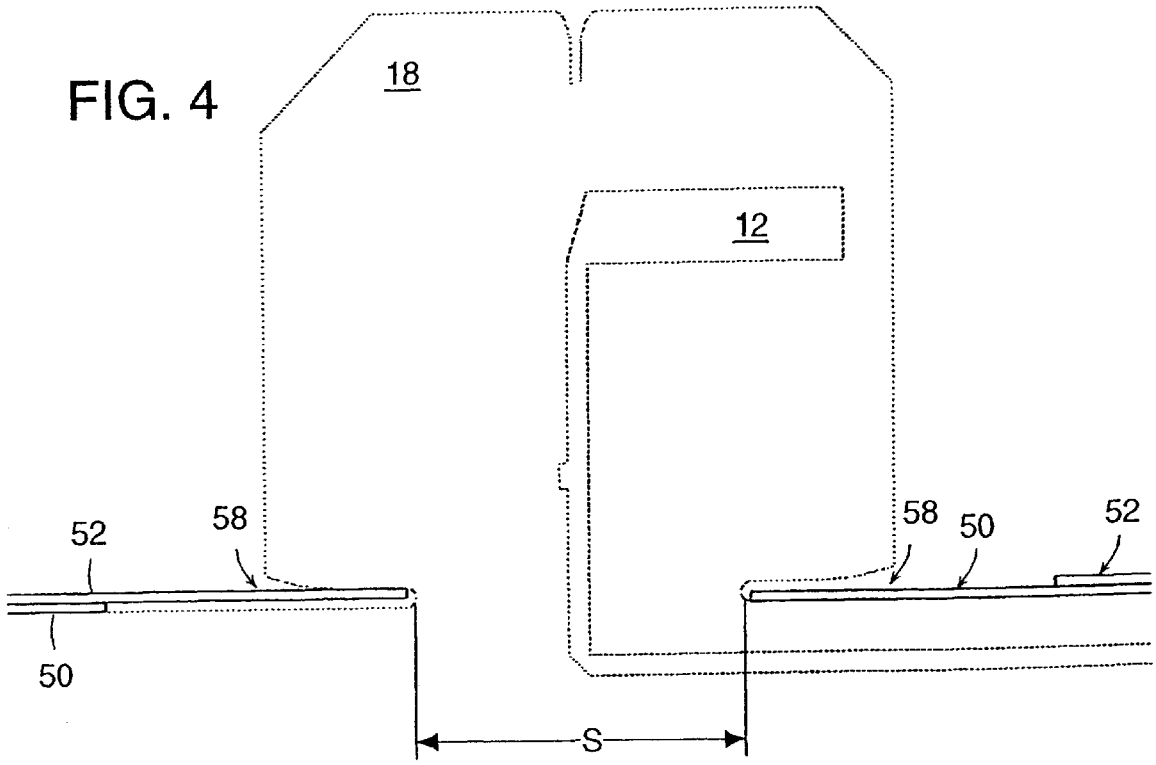
FIG. 4 is a side view in cross section of a radiator board extending above interlocking ground sheets in accordance with an embodiment of the present invention.

Returning to the exploded view of FIG. 2, two ground sheets 50, 52 serve several important mechanical and electrical purposes. A plurality of slots 54, 56 one for each radiating element, are cut into each ground sheet 50, 52. Each slot 54 must be long enough to accommodate the size of the dipole element. However, this slot is long enough to support modes that radiate within the band of the antenna. These modes have a detrimental effect in that they easily couple electromagnetically to the field of the microstrip network that must pass through the slot to excite the dipole element. Moreover, the radiation produced by these modes is cross-polar (i.e., linearly polarized in an orthogonal direction) with respect to the desired linear polarization of the antenna. Indeed, when only a single ground sheet 50 is used, cross-polar levels only 12 dB down from the peak of the co-polar beam were measured, which is unacceptable for communication applications. This problem is remedied by using two ground sheets 50, 52 in which the slots 54, 56 are offset to the center location of the radiating elements 12. Grooves 58 are cut into the substrate of radiator boards 18 in order to accommodate the thickness of the two ground sheets 50, 52, so that when the ground sheets are slid into the grooves, each in an opposite direction, the effective slot is much shorter, as shown in FIG. 4. While radiator boards 18 are characterized by a width w governed by the lengths of the radiating elements, each radiator board is notched by groove 58, such that when ground sheets 50 and 52 are inserted, an effective slot of length s is created. The effective slot of length s supports only modes at much higher frequencies, which are out of the frequency band of the antenna. The result is that the cross-polar levels are far reduced, typically as much as 27 dB down, and the excitation energy originally intended for radiation by the dipoles is no longer perturbed by these resonant modes.

Referring, again, to FIG. 2, additional mechanical and manufacturing benefits may be realized by using interlocking-ground sheets 50, 52, and further, when interlocking cross-braces 60 are inserted across the top of each successive row of radiator boards 12. The composite structure of circuit board material, metal ground sheets 50, 52 and cross-braces 60 (made from either conductive or insulating material) results in a very strong assembly that is with cost and manufacturing advantages. Indeed, this structure may readily support wind load forces produced by 125 mph wind speeds. Wind load force is transferred through the assembly from the face of an electrically thin radome 62, which is in contact with the top of the cross-braces 60, to the antenna back structure 26. Radome 62 is mechanically fastened only to the antenna back structure 26 along the sides of the antenna and protects the network board, radiator boards, and associated circuitry, from environmental effects. This construction advantageously allows the internal circuit board assembly to expand and contract at a different rate from that of the external antenna components.

Absorber Strips

Strips 64 of microwave absorber, shown in FIG. 2, serve to attenuate any cavity modes that may resonant within the electrically closed structure formed by ground sheets 50, 52 and the antenna back structure. Such parasitic cavity modes may be excited by radiation occurring from the microstrip networks and transitions. The presence of these modes may perturb the desired excitation that the beam forming networks are delivering to the radiating elements. Absorber strips 64 are fastened to the underside of ground sheets 50, 52, and are preferably sized so that they do not come within 3 times the substrate thickness distance to the microstrip networks and lens features.

The described embodiments of the invention are intended to be merely exemplary and numerous variations and modifications will be apparent to those skilled in the art. All such variations and modifications are intended to be within the scope of the present invention as defined in the appended claims.

What is claimed is:

1. An antenna array comprising:

a. a multi-beam forming network disposed on a circuit board in a network board plane; and b. a plurality of radiator boards, each radiator board disposed in one of at least one radiator board plane, each radiator board plane being perpendicular to the network board plane, the radiator boards forming successive rows and characterized by a width; and c. a plurality of radiator elements, a subset of the radiator elements disposed on each radiator board, each radiator element coupled to the multi-beam forming network such that the plurality of radiator elements create at least two beams, each beam directed in an independently specified direction.

2. An antenna array in accordance with claim 1, wherein the multi-beam forming network is a time delay structure.

3. An antenna array in accordance with claim 1, wherein the multi-beam forming network is a Rotman lens having a plurality of beam ports.

4. An antenna array in accordance with claim 3, wherein pairs of beam ports are each coupled to a single input connector.

5. An antenna array in accordance with claim 3, further including an array port circuit for coupling energy to the radiator boards.

6. An antenna array in accordance with claim 5, wherein the array port circuit further comprises at least one attenuator.

7. An antenna array in accordance with claim 1, each radiator board further including an elevation feed network.

8. An antenna array in accordance with claim 1, wherein each radiator element is a dipole element.

9. An antenna array in accordance with claim 1, further comprising a first ground sheet, the first ground sheet having a plurality of slots, one of the radiator boards extending through each slot of the first ground sheet.

10. An antenna array in accordance with claim 9, further comprising a second ground sheet, the second ground sheet having a plurality of slots, one of the radiator boards extending through each slot of the second ground sheet.

11. An antenna array in accordance with claim 10, wherein each radiator board is notched in such a manner that the first and second ground sheets may interlock with the radiator board to create a plurality of effective slots in a ground plane, the effective slots narrower than the characteristic width of the radiator board.

12. An antenna array in accordance with claim 1, further comprising a plurality of cross braces, one cross brace disposed across each row of radiator boards.

13. An antenna array in accordance with claim 1, further comprising a radome having no mechanical contact with either the network board or the radiator boards, for shielding the multi-beam forming network and radiator boards from environmental effects.

14. A method for generating multiple antenna beams, the method comprising:

a. fabricating a radiator element on each of a plurality of radiator boards;

b. supporting the plurality of radiator boards at right angles to a network board; and c. exciting each radiator element with a signal phased by means of a multi-beam forming network disposed on the network board and the radiator boards, so as to generate the multiple antenna beams, each beam directed in an independently specified direction.

* * * * *